United States Patent [19]

Montijo

[11] Patent Number: 4,640,513

[45] Date of Patent: Feb. 3, 1987

[54] SUPER MEMORY EDUCATIONAL GAME OF SKILL AND CHANCE

[76] Inventor: Robert Montijo, P.O. Box 629, Brooklyn, N.Y. 11211

[21] Appl. No.: 732,584

[22] Filed: May 10, 1985

[51] Int. Cl.[4] ..... A63F 3/00; A63F 9/18

[52] U.S. Cl. ..... 273/249; 273/266; 273/272; 273/273; 273/142 R

[58] Field of Search ..... 273/249, 242, 243, 266, 273/272, 273, 142 R

[56] References Cited

U.S. PATENT DOCUMENTS

| | | | |
|---|---|---|---|
| 1,421,656 | 7/1922 | Abele | 273/266 |
| 1,635,734 | 7/1927 | Ziegler | 273/249 |
| 3,405,459 | 10/1968 | Belokin, Jr. | 273/142 R X |
| 3,743,293 | 7/1973 | Chodorou et al. | 273/266 |
| 3,939,578 | 2/1976 | Coffey | 273/243 X |
| 4,089,527 | 5/1978 | Roth | 273/273 X |
| 4,109,918 | 8/1978 | Mele et al. | 273/243 X |
| 4,572,513 | 2/1986 | Evans | 273/242 |

FOREIGN PATENT DOCUMENTS

| | | | |
|---|---|---|---|
| 543155 | 2/1942 | United Kingdom | 273/142 R |
| 847447 | 9/1960 | United Kingdom | 273/142 R |
| 394052 | 12/1972 | U.S.S.R. | 273/273 |

*Primary Examiner*—Paul E. Shapiro
*Attorney, Agent, or Firm*—Richard L. Miller

[57] ABSTRACT

A super memory educational game of skill and chance is provided and consists of a board game for ages eight years old thru adult ages and is played in seven basic ways. Players take turns trying to spell, pronounce and define words correctly, remember number sequences, answer question cards, play game chips on the square board and play the bonus chance game. All seven functions are played simultaneously as the game progresses. Various methods of game rules are included in which a method can be elected by the players. Participant activities are timed according to a preselected time length using a timing device. The play money is used to reward or penalize players for incorrect moves. The first player to reach the winner's circle by completing movement around the board and fulfilling the required activities is the winner. The pot of money accrued during the game is then awarded to the winner. The game can be geared toward different age levels and educational backgrounds from elementary to college.

Vocabulary and question cards can be produced to satisfy various occupational backgrounds such as science, mechanics, construction, etc. Also foreign languages can be introduced.

11 Claims, 18 Drawing Figures

Fig. 1
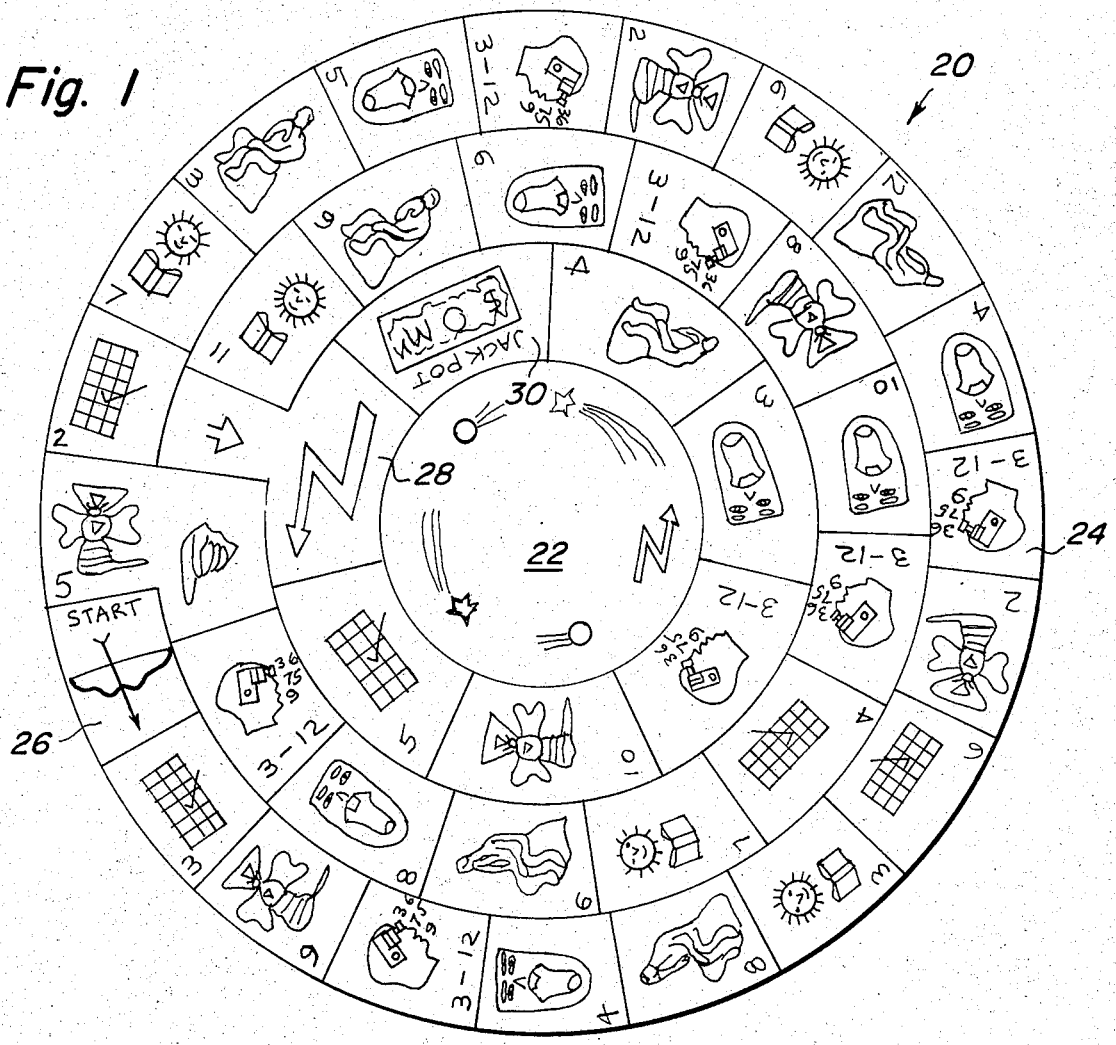
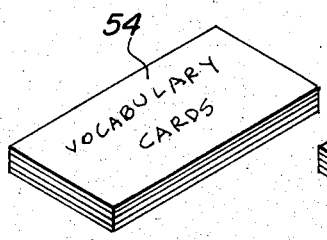
Fig. 3
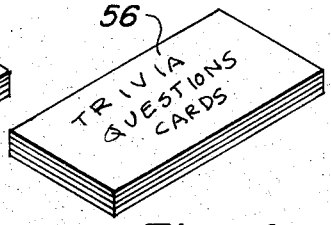
Fig. 4
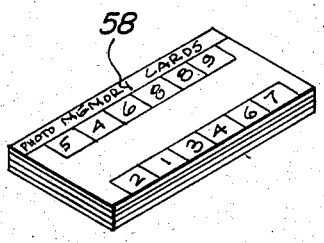
Fig. 5
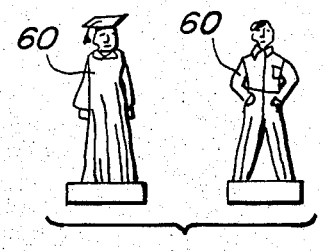
Fig. 6
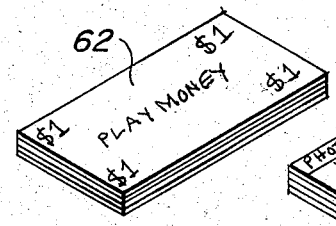
Fig. 7
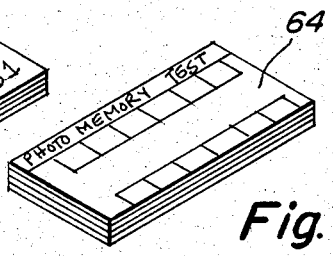
Fig. 8

Fig. 2
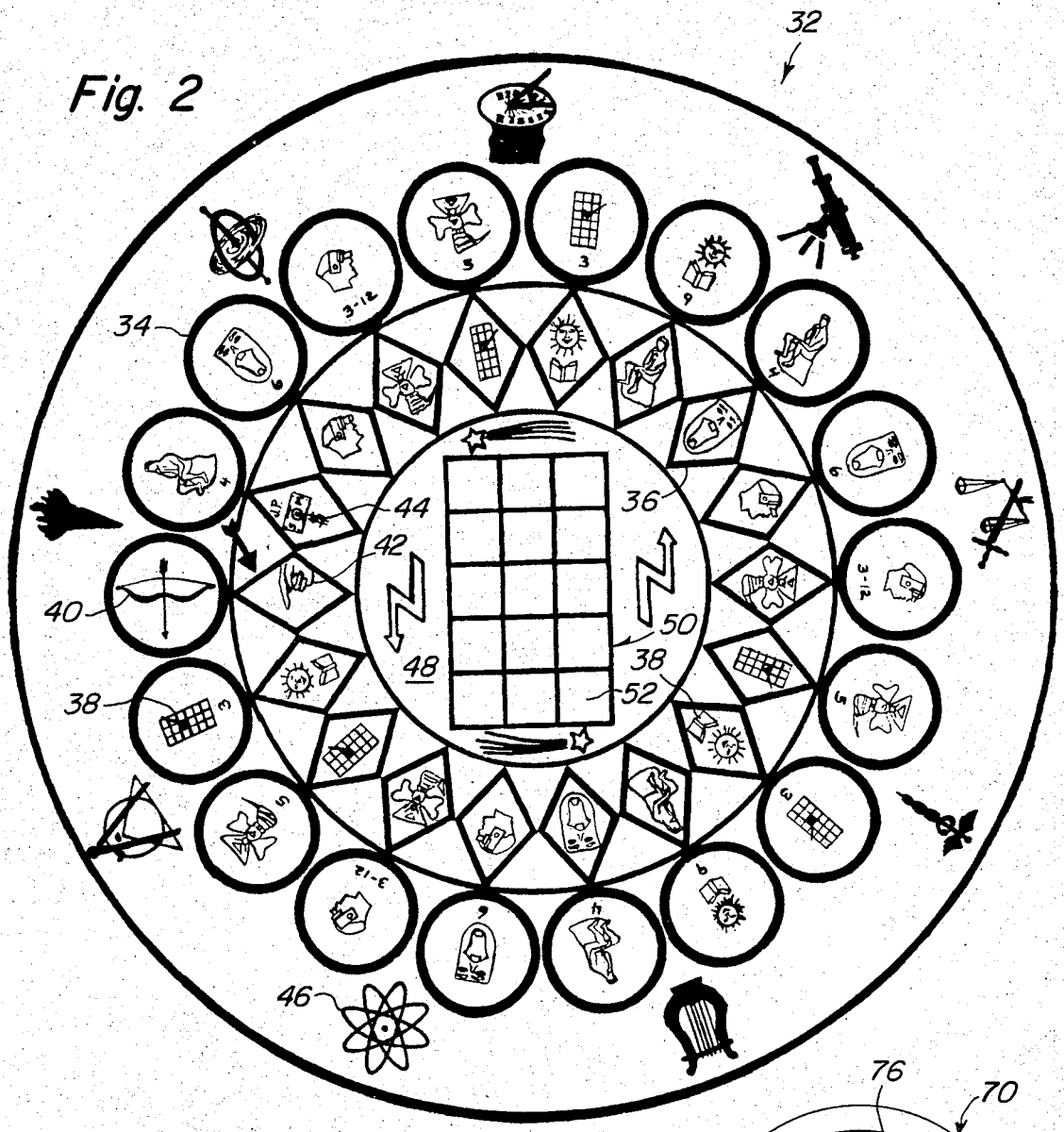
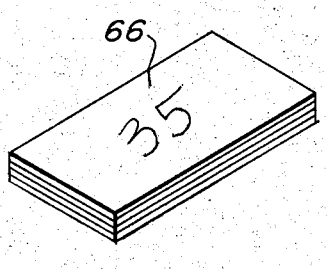
Fig. 9
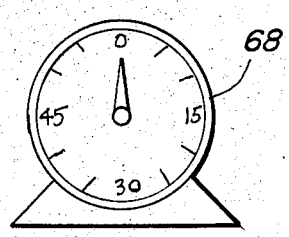
Fig. 10
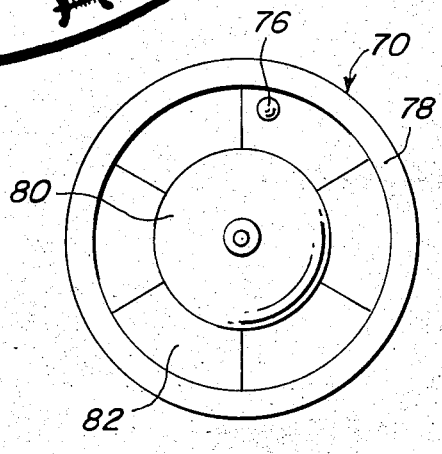
Fig. 11

SUPER MEMORY EDUCATIONAL GAME OF SKILL AND CHANCE

BACKGROUND OF THE INVENTION

The instant invention relates generally to board games and more specifically it relates to a super memory educational game of skill and chance.

Numerous board games have been provided in prior art that are adapted to provide either learning instruction, such as questions and answers on various subject matters or skill and chance that enhances enjoyment of the game. Most board games are limited to provide only one of these types of benefits.

SUMMARY OF THE INVENTION

A principle object of the present invention is to provide a super memory educational game of skill and chance which avoids the aforementioned problems of prior art board games.

Another object is to provide a super memory educational game of skill and chance which combines educational benefits as well as skill and chance.

An additional object is to provide a super memory educational game of skill and chance which allows each player to play seven functions simultaneously as the game progresses.

A further object is to provide a super memory educational game of skill and chance that is economical in cost to manufacture.

A still further object is to provide a super memory educational game of skill and chance that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a top plan view of a first type game board.

FIG. 2 is a top plan view of a second type game board.

FIG. 3 is a perspective view of a deck of vocabulary cards.

FIG. 4 is a perspective view of a deck of trivia question cards consisting of multiple choice cards and true or false question cards.

FIG. 5 is a perspective view of a deck of photo memory presentation cards.

FIG. 6 is a front elevational view of two typical playing pieces.

FIG. 7 is a perspective view of a pile of dollar bill play money.

FIG. 8 is a perspective view of a photo memory test paper pad.

FIG. 9 is a perspective view of a deck of sixty second timer cards.

FIG. 10 is a front elevational view of a sixty second timing device.

FIG. 11 is a top plan view of a roulette wheel.

DETAILED DESCRIPTION OF THE PREFERRED EMBODIMENTS

Figure 12:
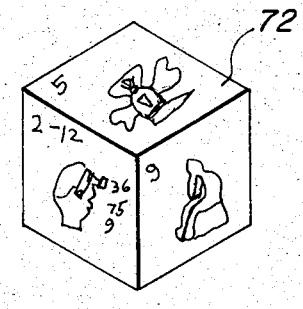
FIG. 12 is a perspective view of a bonus die.

Turning now descriptively to the drawings, in which similar reference characters denote similar elements throughout the several views, FIG. 1 illustrates a first type circular game board 20 that contains thirty nine illustrated squares and an inner bonus circle 22, thirty six squares 24 will have a color code with game symbol and numbered score points imprinted, two squares 26, 28 directional and final square 30 is winner's jack pot.

A second type circular game board 32 is shown in FIG. 2 which contains eighteen circular spaces 34 and eighteen diamond shaped spaces 36. Thirty three spaces 38 will have a color code with game symbol and numbered score points imprinted in each game space, two spaces 40, 42 directional and final space 44 is winner's jack pot. Professional or occupation symbols 46 are illustrated around circumference. Other symbolic designs not shown may be substituted around circumference to enhance the game board such as comic book super-heroes. An inner circle 48 will have an imprinted check-a-chip rectangular game 50 with three vertical by five horizontal rows of fifteen squares 52.

The materials to be included with either game board 20 or 32 are as follows:

FIG. 3 is one thousand printed vocabulary cards 54 with word definition usage and correct spelling on one side or both sides.

FIG. 4 is one thousand trivia multiple choice and true or false question cards 56 in an intermixed assortment.

FIG. 5 is a deck of one hundred printed photo memory game presentation cards 58 containing a series of twelve different numbers.

FIG. 6 shows two of four playing pieces 60 being in the shape of persons.

FIG. 7 is two hundred super memory play-money single dollar bills 62.

FIG. 8 is a hundred sheeted paper pad 64 with twelve illustrated blank squares to be filled in when playing photo memory.

FIG. 9 is a sixty seconds timer card deck 66 numbered from one to sixty seconds with same number on both sides of each card which can be counted out to simulate a clock counter.

FIG. 10 shows a sixty seconds timer clock device 68 that can be substituted for the sixty seconds timer cards 66.

Figure 13:
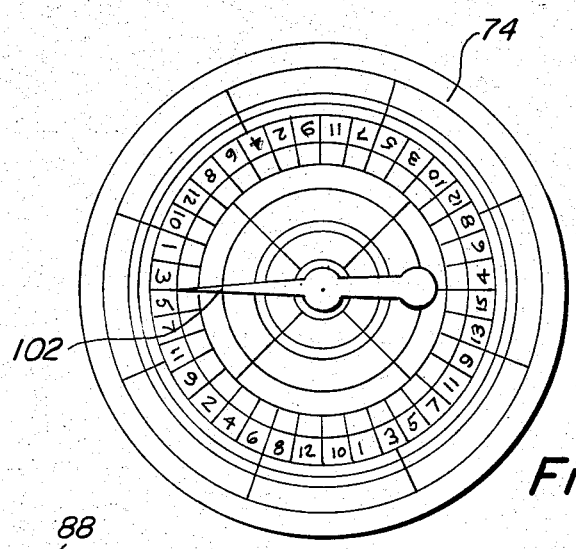
FIG. 13 is a top plan view of a manual chance determining arrow wheel.
Figure 14:
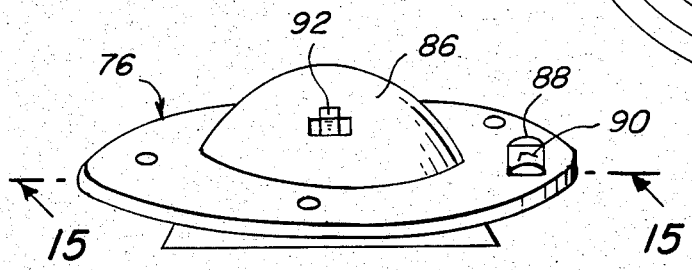
FIG. 14 is a perspective view of a battery chance determining space saucer.
Figure 15:
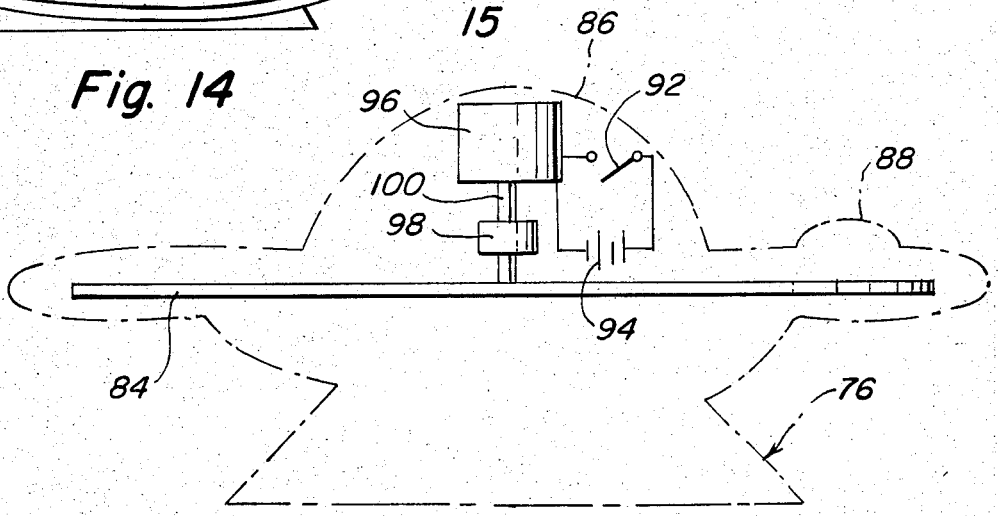
FIG. 15 is a diagrammatic cross sectional view taken along line 15—15 in FIG. 14 showing the internal mechanism.

A choice of bonus unit items described in greater detail after which there are four. Roulette wheel 70 in FIG. 11, a bonus die 72 in FIG. 12, a manual powered arrow wheel 74 in FIG. 13 and a battery powered UFO spaceship saucer 76 in FIGS. 14 and 15.

Figure 16:
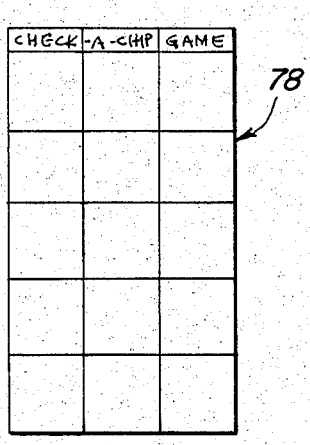
FIG. 16 is a top plan view of a rectangular check-a-chip game.

FIG. 16 is a separate check-a-chip game 78 used with game board 20. The check-a-chip game 50 is imprinted on the inner circle 48 of the game board 32.

Figure 17:
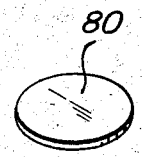
FIG. 17 is a perspective view of a typical chip used for the check-a-chip game.

FIG. 17 is one of fifteen chips 80 used for the check-a-chip game 50 or 78.

Figure 18:
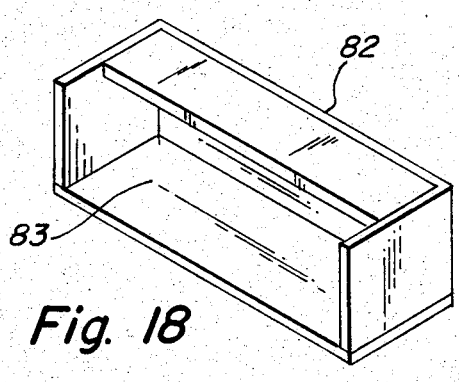
FIG. 18 is a perspective view of a container having a compartment for holding cards therein.

FIG. 18 is one of the containers 82 that has compartment 83 for holding cards therein.

The Game boards 20 and 32 each feature seven short games which are:

1—CHECK-A-CHIP,
2—SUPER SPELLING BEE,
3—THINKER,
4—PRONUNCIATION,
5—PHOTO MEMORY,
6—DEFINE, AND
7—BONUS GAME.

Each game will have its own color code, game symbol and point score number imprinted. Each game with the exception of the bonus game will have its own color code game symbol and point score number imprinted. The bonus game will have all six color codes and symbols to correspond with each game.

On the inner circle 22 of game board 20 the Roulette wheel 70 could be placed. The roulette wheel 70 used by rolling a small ball 76 around a shallow bowl 78 with an inner disk 80 revolving in an opposite direction. The ball 76 finally comes to rest in one of the various six numbered color coded compartments 82 into which the disk 80 is divided thus determining the extra bonus points. The roulette wheel 70 is to be used in a king size family board game as a special attraction. The roulette six colors and symbols correspond with the colors and symbols of the six short games described before.

Another item which can take the place of a roulette wheel would be a round UFO type spaceship saucer unit 76 with an inner disk wheel 84 with the imprintations of the six color codes and symbols (including score points) in various spaces around the wheel 84. It would have a metal or plastic dome cover 86 with a small magnifying glass window 88 to show the indicated symbol or color code and numbered points 90. The plate disk wheel 84 would spin when activated by pressing a start and stop button or on and off switch 92. The unit 76 would be powered by a battery 94 to run a motor 96 having a free wheeling clutch 98 on shaft 100 to the disk wheel 84.

For the less expensive family board game a six colored die 72 with six different score points imprinted from two thru twelve will be used. The bonus die 72 item is to be for the production of a less expensive family board game.

Another item which is also inexpensive to produce and fulfills the same effect is the flat disk wheel 74 with a tin arrow 102 at its center, which can be spun with the flick of a finger tip.

Before a player is entitled to activate a bonus game unit player must have successfully succeeded in a game activity currently played. A bonus device is activated so that when the indicated color code or symbol matches with the corresponding game just played the player may receive the bonus points or extra space move depending on the chosen game method being played.

The color scheme may be modified in order to enhance appearances. It is also not essential to maintain the use of the six color coded ideas. The circles and diamonds or squares may be of one or two colors, whichever color scheme enhances the game more attractively.

RULES AND REGULATIONS (A) At the beginning start of the Super Memory game board 20 or 32 a bow and arrow symbol 26 or 40 points towards the direction in which to move. All playing pieces 60 will be positioned there at the start of the game.

(B) A minimum of two players can play the game. Both shall act as dealer and player to each other.

(C) Amount of players to participate are limited to the amount of playing pieces 60 it takes to fill a circle 34 diamond 36 or square space 24 the amount of card compartments and play money 62 available.

(D) Each game activity is to be played at a limited time span:

(1) CHECK-A-CHIP—ONE MINUTE
(2) THINKER—TWENTY SECONDS
(3) PRONUNCIATION—THIRTY SECONDS
(4) SUPER SPELLING BEE—THIRTY SECONDS
(5) PHOTO MEMORY—FIFTEEN SECONDS
(6) DEFINE—ONE MINUTE

The suggested timing arrangement as specified above can be flexibly adjusted by participants to satisfy a desired pace. Participants must elect a timing change only prior to the start of Super Memory game. Allowable changes are as follows:

(1) Designating the length of time during which the numerical sequences would be exposed in playing Photo memory.

(2) Designating the length of study time in studying vocabulary word cards.

(3) Changing the limited time span to play any of the six game forms described above.

(E) Tie breakers must play Check-a-Chip with each other for the final decision.

WAYS TO PLAY GAMES

Three ways to play Super Memory are included with either game board 20 or 32. Players at start of game will elect a chosen method.

1. Cash penalty way: At the start of Super Memory forty one dollar play money bills 62 are handed to each player by dealer. As the game activities are played one dollar bills are paid by unsuccessful players. In order to advance spaces a participant must first succeed a game activity currently performed and is liable to remain stationary until accomplishing the required task in which participant must wait another turn for the attempt. If when participant runs out of cash he eventually must be disqualified and must suffer defeat. If he finishes first the player collects the pot of jack pot play money cash. Bonus space advances are obtained through the use of a bonus unit.

2. Point score way: As a participant succeeds in winning any of the game activities landed on he will receive the designated point score imprinted in the space. Points would not be received if unsuccessful but the player may continue to the next space and is not liable to remain stationary. All participants must total up their points to determine a winning score when reaching the finish and jack pot space 30 or 44.

3. No penalty way: Game is played same as way No. 1 (cash penalty way) except for the following minor changes;

a. Money will not be handed to the players but a certain amount is set aside as jack pot prize cash.

b. Money penalty will not be charged. This method lengthens much more than methods 1 or 2 being that a player is not liable towards disqualification (the loss of money funding rule does not apply).

c. Participants are liable to remain stationary until a following turn to attempt the required activity again.

CHECK-A-CHIP INSTRUCTIONS

1. Rectangular boards 50 to 78 consist of fifteen squares, three vertical by five horizontal rows.

2. There are fifteen chips 80 to this game. One chip to each square would be positioned.

3. Dealer flips a coin and player calls heads or tails for the first move.

4. Player or dealer starts off by removing one or two or three chips from any placed position. If the participant wishes he can remove a complete vertical row consisting of five chips (other turns four or five) but when doing this the entire row must be taken, not leaving one chip to remain in this chosen vertical row.

5. Both player and dealer by turns continue to do this until one participant is caught with the last remaining chip 80 on his final move. He is the loser.

6. A player is limited to sixty seconds to play the game which will be timed by the usage of the sixty seconds card deck timer 66 or clock 68. The timer stops when it's the dealer's turn and re-continues when it's the player's turn again.

Super Memory game rules using Method 1

Cash penalty method:

1. Dealer shall hand forty play dollars 62 to each player.

2. Dealer shall hand out five word cards from the one thousand vocabulary card deck 54 to each participant.

a. Participants are given one minute study time to remember definitions, spelling and pronunciations.

b. After the study period they must submit their cards to the dealer in which they would be kept in separate compartments 83 knowing the cards belonging to a particular participant.

c. As the game progresses and the activities are performed the card compartments 83 would be empty in which the dealer must hand out five other word cards and timed in the same process as before. Participants prior to the start of Super Memory may elect by vote to have incorrect cards returned to them along with other new cards for a total of five cards in their possession to be studied. They may elect to have the incorrect and already used cards returned to the back of card deck and be handed five fresh unused cards to each participant for study. Now to begin:

3. When a player lands on a check-a-chip space the player must win the dealer when playing this game activity in order to advance one space. After winning the dealer the participant may spin the roulette wheel or other bonus item. If after spinning a symbol or color code corresponding with the game currently won, the participant would advance an additional space. If the game activity had been won by the dealer the participant would remain stationary until a next turn attempt. Each failing attempt calls for a dollar penalty to be contributed to the jack pot.

4. When a player lands on Super Spelling Bee space the dealer picks a word card 54 from compartment 84 and pronounces the word with its proper definition. The participant responds by properly spelling the word correctly and then is able to advance one space. This would qualify to activate a bonus unit for an attempt to correspond the indicated result to the symbol or color code of game space currently won. If a match occurs an extra space advance is allowed. But if participant defaults in spelling word correctly he would be obligated to remain there and charged a one dollar penalty.

5. When a player lands on a Thinker space the dealer selects a question card from the one thousand intermixed multiple choice and true or false card deck question would be read in which the participant must respond with a correct answer. But if participant gives an incorrect answer same as above applies.

6. When player lands on Pronunciation space the dealer would select one of the five word cards 54 and would read the definition without revealing the word. The participant must respond by remembering the word and pronouncing it correctly for a space advance and bonus try. Penalty and bonus rules, same as above applies.

7. When a player lands on a photo memory space the dealer would expose to the participant (player) a twelve numbered presentation card 58 in which the player would be given fifteen or less seconds to memorize the twelve figures. After testing the participants would fill in the blank spaces on their score test sheet 64 with the numbers previously exposed and in the exact sequence and position. Participants must get a minimum score of nine numbers in consecutive order to advance one space, ten numbers to advance two spaces, eleven to advance three spaces, twelve to advance four spaces.

A first wrong number in the sequence disqualifies all subsequent numbers. One dollar penalty must be paid for each incorrect subsequent numbers not meeting with the minimum nine score requirement. Players that are successful would obtain a bonus tryout for one additional space advancement. Unsuccessful participants must remain at space until a next turn chance to try again.

8. When a player lands on a Define space the dealer (operator) would select a word card 54 from participant's compartment 83 and pronounces the word, in which the participant would respond by giving a proper definition in accord with the word card's definition (can be defined using own words). The player may challenge the word card's definition by responding with a definition thought to be in the dictionary. If when referring to the dictionary and player is incorrect he forfeits an additional one dollar penalty. One advance space move is given to correct player and a bonus spin is then activated for the bonus space advancement. Incorrect players must remain and pay a one dollar penalty.

Rules to Super Memory using Method 2

1. When playing with this score method a player continuously advances and is not liable to remain stationary even if a participant defaults in achieving a required game task to receive points.

2. Before a player is allowed to use a bonus item participant must receive points from a game space as currently being played.

Now to begin:

3. Check-a-chip Player must win dealer when playing check-a-chip in order to obtain points in any amounts from two to twelve points as imprinted in game space. Die 72 or bonus item is activated for the extra bonus points.

4. Super Spelling Bee-Correct spelling of a word would receive points from Two to twelve or as imprinted in game space. Bonus item is then activated for extra points.

5. Thinker-Player gives required answer and if correct receives indicated points. Bonus item would then be activated by player.

6. Pronunciation-Players receive points indicated when correct pronunciation is given Bonus item would be activated.

7. Photo Memory. When player lands on Photo Memory game space participant must get a minimum of nine numbers in consecutive order to receive three points, ten to receive six points, eleven to receive nine points, twelve to receive twelve points. Bonus item is then activated for the added points.

8. Define. Correct definition is required to receive indicated points. Players may challenge the word's definition by giving a definition believing to be in dictionary. If incorrect when referring to the dictionary forfeits additional points by subtracting the points imprinted in game space from participant's score listing. Players who are correct would qualify to activate a bonus item to obtain extra points.

Accordingly it is to be understood that although two methods have been illustrated for playing the instant invention that there are numerous other ways yet to be devised and that the illustrations are exemplary only and are in no way to be construed as a limitation upon the instant invention.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A super memory educational game of skill and chance which comprises:

(a) a circular game board having consecutive spaces defining a path of travel, a plurality of said spaces having color codes with game symbols identifying games including a pronounciation game, a define game, a super spelling bee game, a thinker game and a photo memory game, and numbered score points imprinted thereon, two spaces showing direction and final space being a winner jack pot;

(b) a plurality of playing pieces for use by players, said playing pieces being positionable on said spaces;

(c) a plurality of vocabulary card with word definition usage and correct spelling there on to be used when one of said playing pieces lands on one of said spaced indicating pronunciation, define, and super spelling bee games;

(d) a plurality of trivia multiple choice and true or false question cards in an intermixed assortment to be used when one of said playing pieces lands on one of said spaces indicating thinker game;

(e) a plurality of photo memory game presentation cards having a series of numbers thereon to be used when one of said playing pieces lands on one of said spaces indicating photo memory game;

(f) a paper pad having a plurality of sheets with illustrated blank squares to be filled in when playing photo memory game;

(g) Check-a-Chip game board having three vertical by five horizontal rows of fifteen squares to be used when one of said playing pieces lands on said space indicating check-a-chip game;

(h) Fifteen chips to be used for said check a chip game; and (i) a bonus unit device to be used after one of said players properly plays one of said games and including chance determining means for matching with said game just played whereby said player piece can advance an additional space.

2. A super memory educational game of skill and chance as recited in claim 1 further comprising at least one container having a compartment for holding said cards therein.

3. A super memory educational game of skill and chance as recited in claim 2 further comprising a plurality of papers bearing indicia representing one dollar denominations of money.

4. A super memory educational game of skill and chance as recited in claim 3 further comprising means for timing each of said games to limit time span for each of said players.

5. A super memory educational game of skill and chance as recited in claim 4, wherein said timing means is a sixty seconds timer card deck numbered from one to sixty second with same number on both sides of each card for counting out to simulate a clock timer.

6. A super memory educational game of skill and chance as recited in claim 4 wherein said timing means is a sixty seconds timer Clock device.

7. A super memory educational game of skill and chance as recited in claim 4 wherein said bonus unit device is a bonus die with six different score points and game symbols imprinted thereon.

8. A super memory educational game of skill and chance as recited in claim 4 wherein said bonus unit device is a manual chance determining arrow wheel having a plurality of color and score points.

9. A super memory educational game of skill and chance as recited in claim 4 wherein said bonus unit device is a miniature roulette wheel having a plurality of color coded compartments so that a small ball can come to rest within one of said compartments.

10. A super memory educational game of skill and chance as recited in claim 4 wherein said bonus unit device is in the shape of a battery powered UFO spaceship saucer.

11. A super memory educational game of skill and chance as recited in claim 10 wherein said battery powered UFO spaceship saucer comprises:

(a) an inner disk wheel with imprintations of said color codes, game symbols and score points in various spaces around said wheel;

(b) a dome cover having a small magnifying glass window to show said color codes, game symbols and score points;

(c) a battery within said spaceship saucer;

(d) a motor having a shaft to turn said disk wheel, said motor run by said battery;

(e) a free wheeling clutch on said shaft, and;

(f) a switch to start and stop said motor so that said disk wheel would spin when said switch is activated.

* * * * *